US005983394A

United States Patent [19]

Joo

[11] Patent Number: 5,983,394

[45] Date of Patent: Nov. 16, 1999

[54] MALE UPPER GARMENT AND MANUFACTURING METHOD OF REINFORCEMENT PAD FOR USE THEREIN

[76] Inventor: Byongjin Joo, #101 Sunkyong Heights Apt., 478-16 Yeonnam-Dong, Mapo-Ku, Seoul, Rep. of Korea

[21] Appl. No.: 09/072,139

[22] Filed: May 5, 1998

[30] Foreign Application Priority Data

May 6, 1997 [KR] Rep. of Korea ..... 97-17330

[51] Int. Cl.[6] ..... A41B 1/00

[52] U.S. Cl. ..... 2/113; 450/55; 2/455; 2/115; 2/69; 2/267

[58] Field of Search ..... 2/113, 69, 115, 2/267, 268, 109, 114, 455, 456, 463, 467; 450/55, 57

[56] References Cited

U.S. PATENT DOCUMENTS

| | | | |
|---|---|---|---|
| 1,798,008 | 3/1931 | Walter | 2/115 |
| 4,397,636 | 8/1983 | Ganshaw | 2/115 X |
| 4,441,211 | 4/1984 | Donzis | 2/455 |
| 4,675,917 | 6/1987 | Valli . | |
| 4,781,650 | 11/1988 | Budd | 450/55 |
| 4,854,915 | 8/1989 | Luedy | 450/55 |

FOREIGN PATENT DOCUMENTS 90-19724 12/1990 Rep. of Korea .

*Primary Examiner*—Gloria Hale
*Attorney, Agent, or Firm*—McDermott, Will & Emery

[57] ABSTRACT

A male upper garment includes front and back panels whose sides and shoulder portions are sewed to have a neck opening at the top center and arm openings on the upper sides; and a pair of pectoralis major reinforcing means each having a recess for receiving a wearer's left and right pectoralis major muscles, the means' thickness and width being tapered from the bottom end of the recess to the shoulders and from the center of the left and right pectoralis major muscles to the sides, the means being attached to portions opposing the pectoralis major portions on the inner surface of the front panel. With those elements, the garment displays an appearance of a man of a well-developed pectoralis major muscle.

13 Claims, 6 Drawing Sheets

MALE UPPER GARMENT AND MANUFACTURING METHOD OF REINFORCEMENT PAD FOR USE THEREIN

FIELD OF THE INVENTION

The present invention relates to a male upper garment and more particularly, to a male upper garment with a reinforcement pad fastened or detachably attached to the inner surface so that men having weak upper part, especially, pectoralis major (breast muscle), look muscular in summer during which they wear only athletic shirt or T-shirt as their outer upper garment, or do undergarment and outer garment.

BACKGROUND OF THE INVENTION

Generally speaking, during summer at high surrounding temperatures, men and women both wear only athletic shirt or T-shirt as their upper outer garment, or take the outer garment over underclothes.

In this occasion, a man proud of his upper part wears clothes made of an elastic material exposing his physical sillouette, or unfastens one or two buttons of his upper garment, boasting of his masculine beauty.

Meanwhile, for thin women, despite their self-important upper part, they wear brassieres of a large cup or a size-controllable type, or insert a reinforcement pad made of special silicon into the brassiere's cup, for the reinforcement of their breasts, compensating for their physical defects or fulfilling their desire.

Until now, for male upper garments for summer, there has not been suggested or developed any kind of product that makes up men's weak upper part. Presently, self-expressive, insisitent young people (new-generation) tend to wear even sleeveless athletic shirts or tank tops as the outer garment. In terms of such tendency, physical defects possibly act as complex against the opposite sex or friends, avoiding, especially, elastic products coming into tight contact with body.

As a result, men of weak upper part avoid elastic clothes in tight contact with their body but wear loose, large-sized products in order to shield their physical drawbacks, narrowing the selection of various products, hindering them from following the fashion, as well as affecting their mental health due to their complex caused by the defects.

Korean Laid-open Utility Model Publication No. 90-19724 discloses "camisole combined with brassiere" in which a camisole, one of female underwear, is integrally united with a brassiere.

As shown in FIGS. 1A and 1B, the disclosure is constructed in such a manner that, in order to eliminate a separate brassiere to wear, breast portions 5 of an ordinary camisole 1 are made with dual fabrics 3, 3', a nonwoven fabric 4 being interposed therebetween, a sewn portion 7 being provided downward at the center of each of the breast portions 5, an elastic band 6 being attached to the bottom of the breast portions 5.

The camisole is reinforced with nonwoven fabric 4 shaped in conformity with the sillouette of female breasts for the purpose of avoiding a brassiere so that the wearer's breasts are prevented from being shaken while stably positioned in breast portions 5. The elastic band 6 attached to the bottom of breast portions 5 converges the two breasts as well as exposing the female physical beauty.

However, such camisole is characterized only in avoiding wearing a brassiere, as a female underwear in style of one-piece dress, having a large difference from male upper garment. The reinforcement pad of the camisole is shaped to cover only the female breasts and the section is cup-shaped and comparatively thin. For this reason, the shape is very different from that of male well-developed pectoralis major that extends upward from both breast portions to the shoulders at a gentle slope. The camisole is unsuitable for a male garment that can reinforce his weak upper part, as well as being limited in conversion to male upper garment.

Meanwhile, U.S. Pat. No. 4,675,917 discloses a female undergarment that raises the shoulder line, expands the shoulder width and ensures the stability of the shoulder pad by detachably coupling the shoulder pad to a brassiere so that the shoulder sillouette can be modified. The brassiere emphasizes a male shoulder line with the shoulder pad installed on a underwear in tight contact with her body, as well as being easily put on with a fastener to the back or front torso band. However, aside from those advantages, the brassiere is similar to the FIG. 1 camisole in structure, unsuitable for a male garment that should reinforce men's weak upper part while not in close contact with their body.

SUMMARY OF THE INVENTION

Therefore, in order to overcome such drawbacks of the prior art, an objective of the present invention is to provide a male upper garment with a reinforcement pad fixed or detachably attached to the inner surface thereof along at least the silhouette of pectoralis major so that men of weak pectoralis major look muscular.

It is another objective of the present invention to provide a male upper garment with a plurality of detachable reinforcement pads for emphasizing the shoulders and trapezius including pectoralis major.

It is still another objective of the present invention to provide a method of manufacturing a reinforcement pad for a male upper garmanent of a durability with which the restoration of the pad is maintained even through many times of washing.

In order to accomplish the object of the present invention, there is provided a male upper garment comprising: front and back panels whose sides and shouder portions are sewed to have a neck opening at the top center and arm openings on the upper sides; and a pair of pectoralis major reinforcing means each having a recess for receiving a wearer's left and right pectoralis major muscles, the thickness and width being tapered from the bottom end of the recess to the shoulders and from the center of the left and right pectoralis major muscles to the sides, the means being attached to portions opposing the pectoralis major portions on the inner surface of the front panel, whereby the garment displays an appearance of a man of well-developed pectoralis major muscle.

This embodiment may further comprise a deltoid reinforcing pad of the same shape and thickness as those of a well-developed deltoid muscle is further provided on both upper ends of the pectoralis major reinforcing pads, extending therefrom.

A trapezius reinforcing pad of a shape and thickness corresponding to those of trapezius may be further provided on the inner surface of the back panel and attached to a position opposing the wearer's left and right trapezius muscles, displaying an appearance of a man of left and right well-developed trapezius muscles.

In this case, the reinforcing means may be fixedly buried or detachably attached to the inner surface of the front panel.

The upper garment may be applied to tank top, T-shirt or underwear.

The pectoralis major reinforcing means comprises: a pair of pectoralis major reinforcing pads three-dimensionally shaped like pectoralis major muscle and coming into close contact with the outer surface of both breast muscles; and a pair of pad extending portions integrally extending from the top ends of the pectoralis major reinforcing pads to the shoulders.

The reinforcing pads and the pair of pad extending portions are made of nonwoven fabric or elastic synthetic resin that is a flexible, soft, cushiony shape memory material.

For another aspect of the present invention, there is provided a method of manufacturing a reinforcement pad of an excellent restoration ability using a nonwoven fabric, comprising the steps of: curling polyester yarn as a pretreatment process, carding with a carding machine, performing needle punching, and the same times spraying and coating an adhesive binder, to thereby yield carded nonwoven fabric; forming a plurality of conic nonwoven pieces of sequential sizes with the carded nonwoven fabric, using a plurality of presses having a conic reservoir; and sequentially piling the plurality of conic nonwoven pieces, and molding a piled nonwoven fabric with upper and lower molds, to thereby obtain a reinforcement pad of an intended shape.

In the present invention, various reinforcement pads are fixed or detachably attached on the inner surface of the upper garment along the shape of pectoralis major, deltoid or trapezius muscles so that men of weak breasts, especially, the upper part, look muscular with well-developed muscles. Therefore, they can wear tight clothes not reluctantly within a broad range of choice, while appropriately expressing their own individuality along the trend of fashion, as well as eliminating the sense of inferiority against their own physical shape but providing self-confidence.

BRIEF DESCRIPTION OF THE ATTACHED DRAWINGS

These and other features of the invention will be understood more clearly from the following description, read in conjunction with the drawings, in which.

DETAILED DESCRIPTION OF PREFERRED EMBODIMENTS

Hereinafter, preferred embodiments of the present invention will be described with reference to the attached drawings.

Figure 1A:
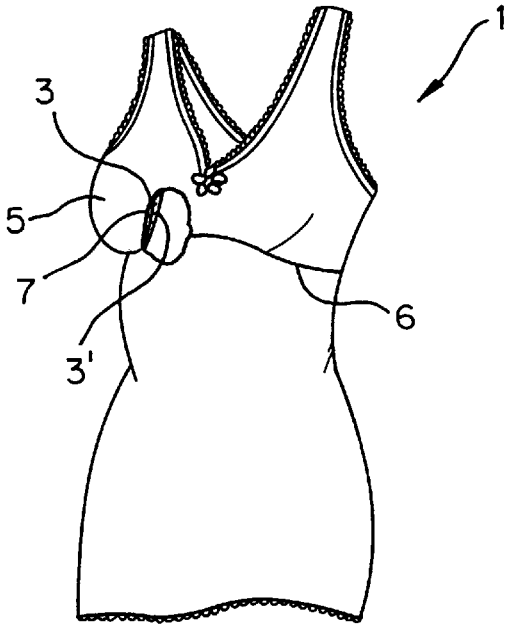
FIG. 1A PRIOR ART
FIGS. 1A and 1B are perspective and section of a conventional camisole combined with a brassiere, respectively.
Figure 1B:
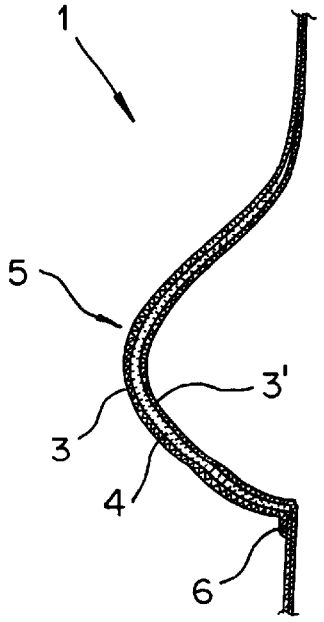
FIG. 1B PRIOR ART
Figure 2:
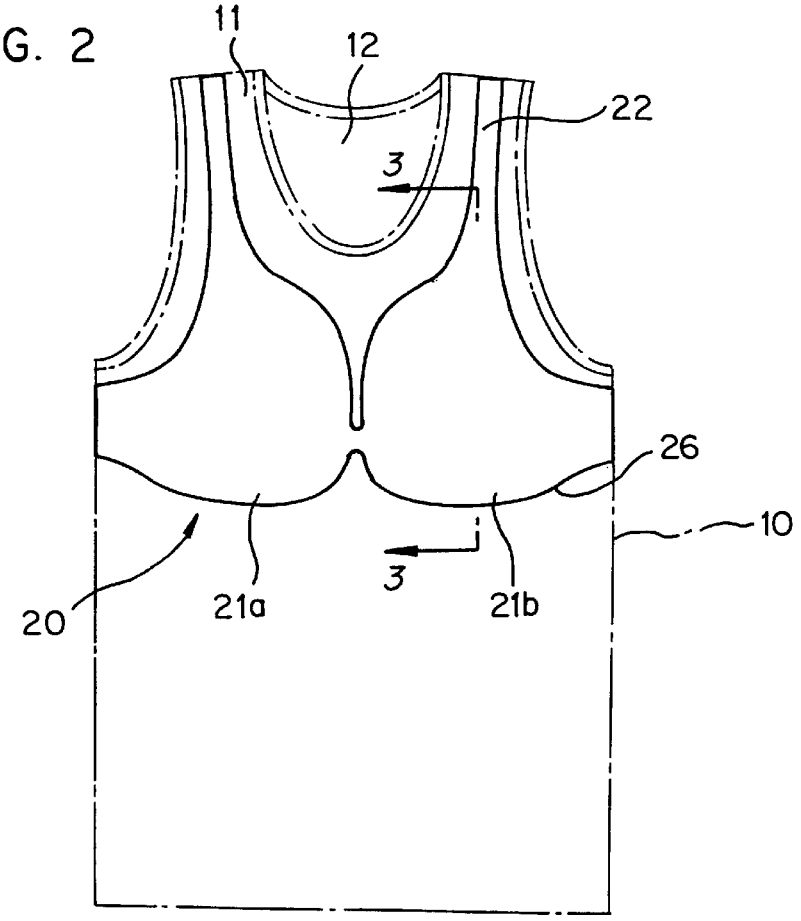
FIG. 2 is a front view of one embodiment of a male athletic shirt attached with a pectoralis major reinforcing pad according to the present invention.
Figure 3:
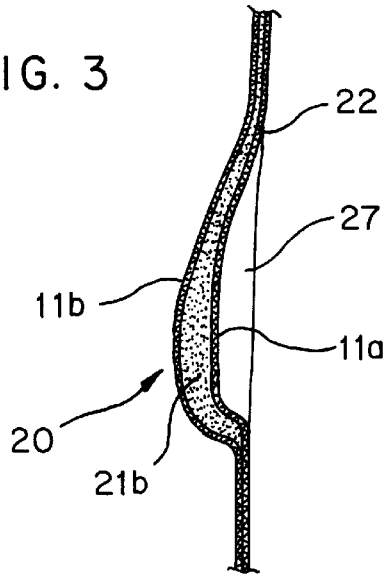
FIG. 3 is a section of the athletic shirt shown in FIG. 2 taken along line A—A.

Referring to FIGS. 2 and 3, one embodiment of male athletic shirt 10 with a pectoralis major reinforcing pad of the present invention comprises: front and back panels 11 and 12 each in shape of an ordinary upper underwear in which a pair of inner and outer layers; and 11*a*, 11*b* made of any fabric of cotton, mixed yarn of polyester and cotton, or flexibility-excellent material are joined and their sides and top are sewn to have openings to allow the head and both arms to pass therethrough; and a reinforcement pad 20 of the shape and thickness of well-developed pectoralis major attached to a portion corresponding thereto between inner and outer skins 11*a*, 11*b*.

The reinforcement pad 20 is made up with a pair of laterally symmetric pectoralis major reinforcing pads 21*a*, 21*b*. As shown in FIG. 3, a recess 27 becoming shallower upwardly is formed in the inner portion of the pads. The outer portion becomes thinner upwardly, and the central portion is preferably separated in the manufacturing process.

The reinforcement pad 20 has a pad extending portion 22 of a predetermined shape and thickness integrally added to pectoralis major reinforcing pad 21*a* so that it has a natural shape of muscle provided from the pectoralis major to the shoulders.

Figure 6:
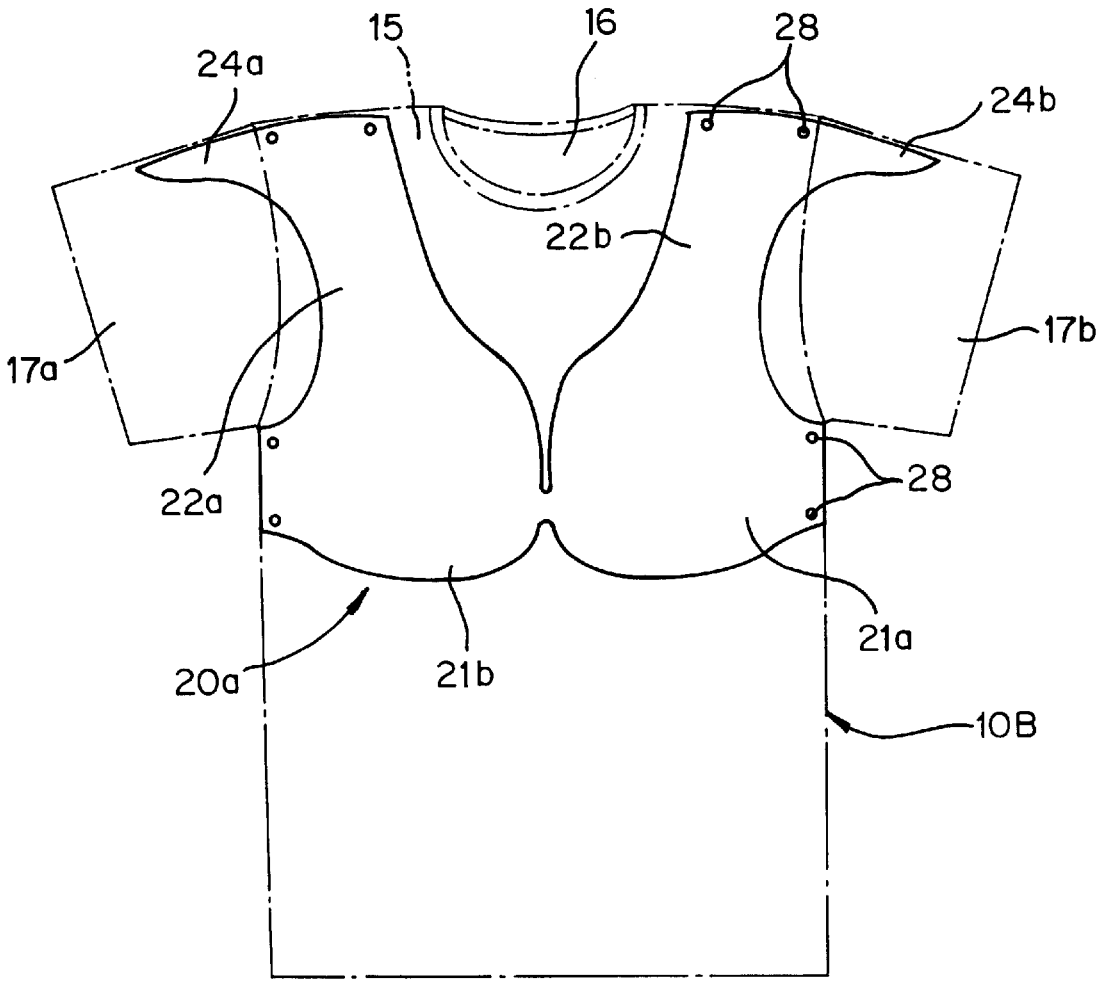
FIG. 6 is a front view of still another embodiment of a male T-shirt attached with a pectoralis major reinforcing pad according to the present invention.

The reinforcement pad 20 may be buried between inner and outer layers 11*a*, 11*b* of front panel 11 to be integrally formed therewith, as shown in FIG. 3, or may have an attaching/detaching connector 28 such as a snap button so that the pad is selectively detached or attached on the inner sides and top of front panel 11, as in FIG. 6, so as to prevent the pad from being damaged during washing. In the latter case, front and back panels 11 and 12 each may be formed of a single outer layer 11*b*. As in FIG. 7, back panel 12 of athletic shirt 10 may add a pair of trapezius reinforcing pads 23*a*, 23*b* covering the portion corresponding to the trapezius so that the wearer's back, the trapezius on both upper sides of his back, is three-dimesionally protruded.

Figure 4:
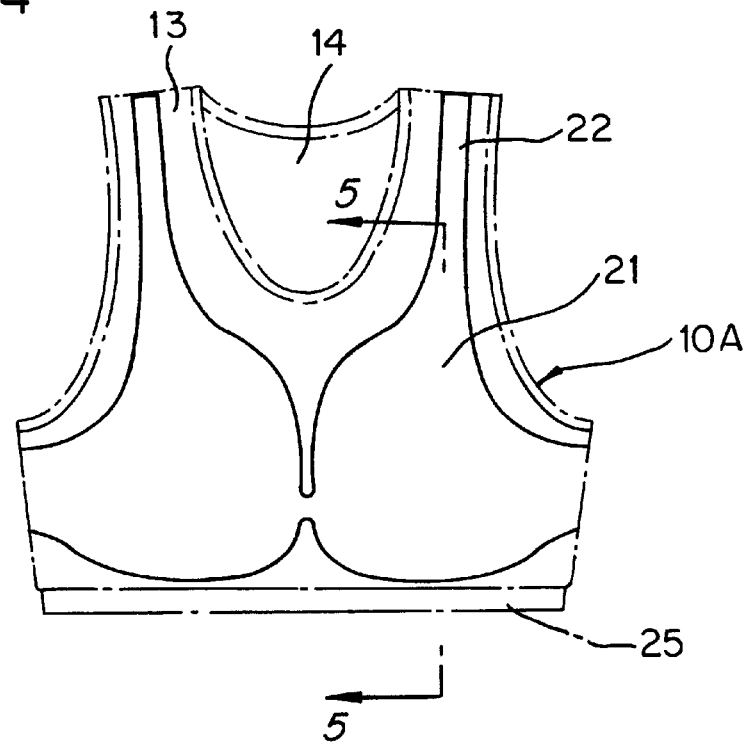
FIG. 4 is a front view of another embodiment of a tank top where where a pectoralis major reinforcing pad is formed in front according to the present invention.
Figure 5:
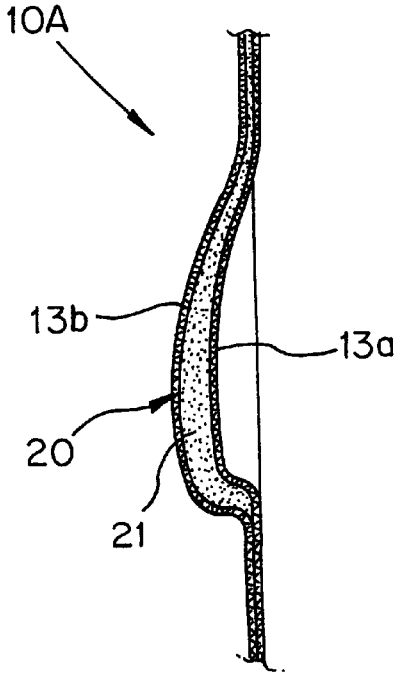
FIG. 5 is a section of the tank top shown in FIG. 4 taken along line B—B.

Turning to FIGS. 4 and 5, the second embodiment of the present invention shows a tank top 10A shaped approximately as the upper part of an exposure-moderate bikini. The tank top consists of front and back panels 13, 14 of a length covering only the upper portion of the breasts in the upper part of body, and a reinforcement pad 20 encased between inner and outer skins 13*a*, 13*b* at a position corresponding to the pectoralis major in the inner portion of front panel 13.

Like the first embodiment, the reinforcement pad 20 has a pair of pectoralis major reinforcing pads 21*a*, 21*b*, and a pair of pad extending portions 22*a*, 22*b* integrally extending from the top end of pectoralis major reinforcing pads 21*a*, 21*b* to the shoulders. The pad 20 of tank top 10A may be detachably secured by attaching/detaching connector 28, and back panel 14 may employ a pair of trapezius reinforcing pads 23*a*, 23*b* constructed as in FIG. 7.

Below the front and back panels 13, 14 may be provided a closely tightening portion 25 of a flexible material extending downward by a predetermined length to embrace and press the belly or waist.

Figure 7:
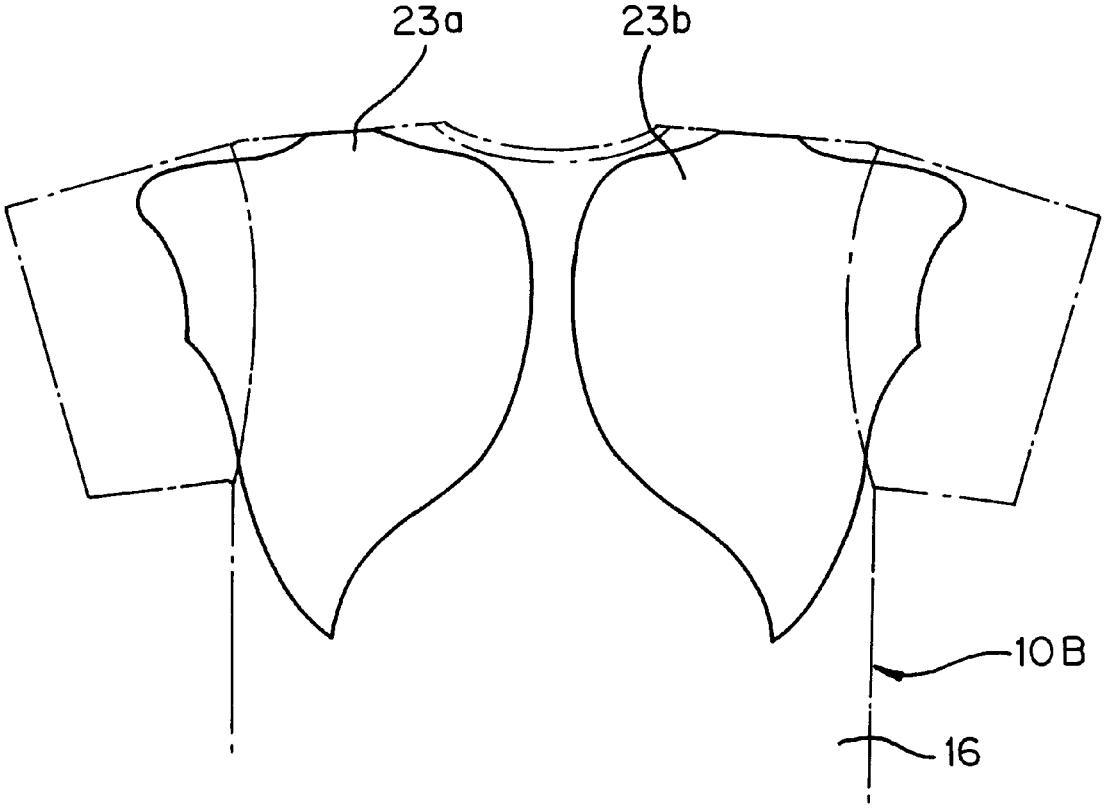
FIG. 7 is a partial back view of a T-shirt with a trapezius reinforcing pad therein according to the present invention.

Referring to FIGS. 6 and 7, the third embodiment of the present invention is a half-length T-shirt. Half-length T-shirt 10B comprises front and back panels 15, 16 having a head inserting hole, a pair of shoulder portions 17*a*, 17*b* having an arm inserting hole, and a reinforcement pad 20*a* of a predetermined shape and thickness in a natural muscle shape integrally extending from the pectoralis major to the deltoid of the shoulders.

The reinforcement pad 20*a* is equipped with a pair of pectoralis major reinforcing pads 21*a*, 21*b* of a predetermined shape and thickness of well-developed pectoralis major attached between the inner and outer layers 11*a*, 11*b* at the portion corresponding to the pectoralis major, a pair of pad extending portions 22*a*, 22*b* integrally extending from the top of pectoralis major reinforcing pads 21*a*, 21*b* to the shoulders, and deltoid reinforcing pads 24*a*, 24*b* mutually connected and extending from pad extending portions 22*a*, 22*b* to the shoulders so that the deltoid muscle on the shoulders looks well-developed.

The third embodiment of reinforcement pad 20*a* of a predetermined shape and thickness exhibits a shape of natural muscle, integrally extending from the pectoralis major portion to the shoulder deltoid portion. Here, T-shirt 10B may add a trapezius reinforcing pad 23, in a similar structure to that of the first and second embodiments, connected to deltoid reinforcing pad 24 on the inner portion of the back panel 16 so that the trapezius on both sides of the upper back looks three-dimensional.

Figure 8:
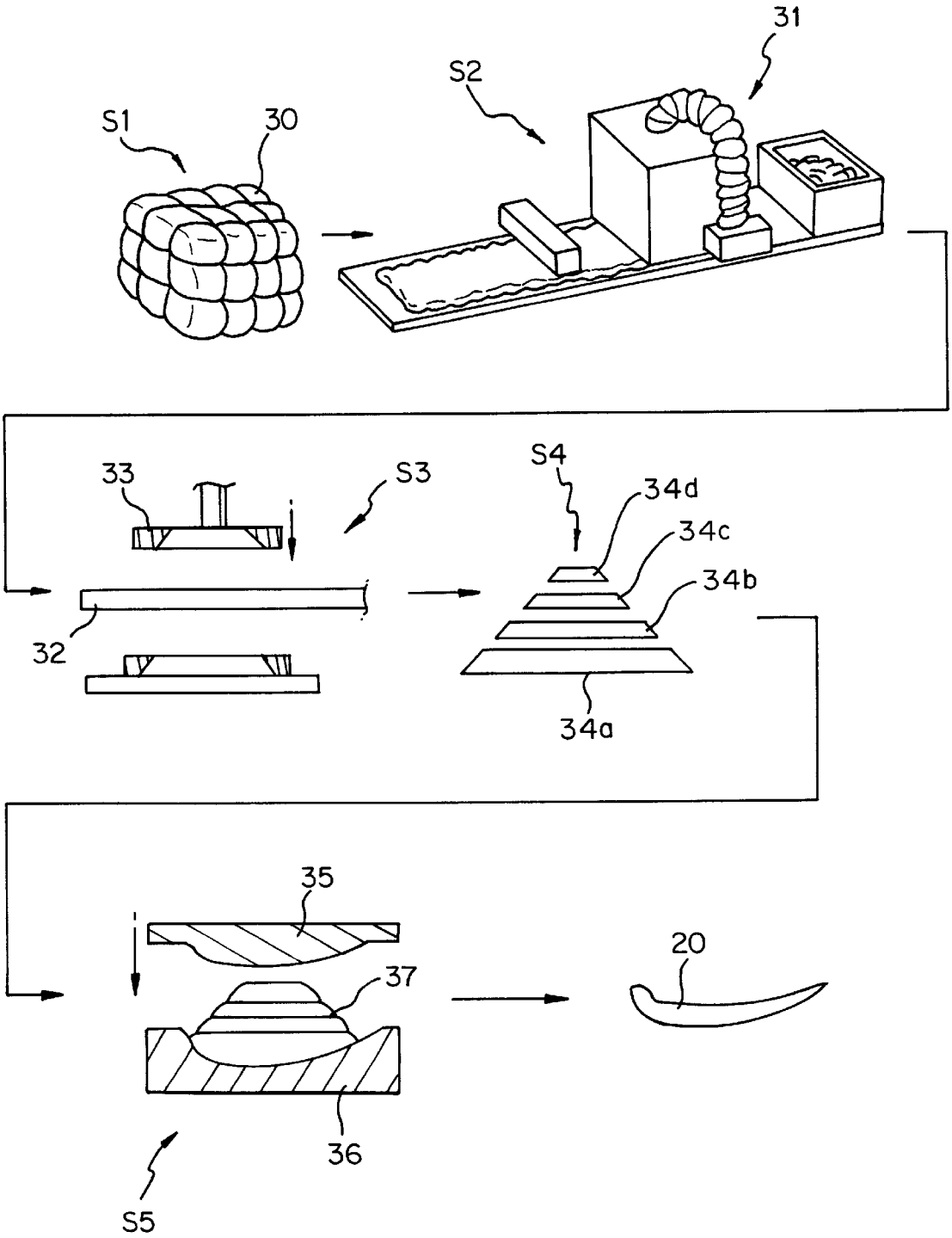
FIG. 8 is a processing diagram of a manufacturing method of a reinforcement pad of the present invention.

The reinforcement pads 20*a*, 23 are preferably made of nonwoven or elastic synthetic resin which is a flexible, soft, cushiony shape memory material, always maintaining its shape. A reinforcement pad of a general nonwoven fabric, if fixedly buried in the front and back panels, needs to be replaced due to the rapidly decreasing restoration and durability through many times of washing. Therefore, in consideration of the disadvantage, the present invention uses a reinforcement pad made through a special manufacturing procedure as in FIG. 8, in order to greatly elongate its durability. This pad employs polyester yarn as nonwoven fabric. First of all, curling is performed in step SI, as pre-treatment process prior to carding polyester yarn 30, for the purpose of increasing elasticity, restoration and durability.

During carding by means of carding machine 31, needle punching is performed for better restoration, and an adhesive binder is sprayed and coated in step S2 for better molding ability in further molding procedure. Subsequently, carded nonwoven fabric 32 is made, in step S3, sequentially into about four nonwoven pieces 34*a*–34*d* of a conic form, using several presses 33 having a conic reservoir cavity thereinside, as in FIG. 8. The fabric's molding ability is enhanced by rendering the center thick but the edges thin at a predetermined rate.

In step S4, the conic processed nonwoven pieces 34*a*–34*d* are piled, and in step S5, piled conic nonwoven fabric 37 is compressively molded at a temperature between 170 and 180° C. with upper and lower molds 35, 36 having a cavity receiving reinforcement pad 20 shown in FIG. 2 so that the nonwoven fabric pieces are mutually coupled as the binder melts, yielding reinforcement pad 20 of an intended shape as in FIG. 2.

The reinforcement pad obtained through the processes goes through needle punching so that it has an excellent restoration ability to maintain its shape even after washing while attached to the product.

The pectoralis major, deltoid, and trapezius reinforcing pads 21*a*, 21*b*, 24*a*, 24*b*, 23*a*, 23*b* attached on the inner surface of the first, second and third embodiments of front and back panels 11–16 are preferably coated of compression preventive material of silicon of a predetermined thickness along sewing line 26 placed on the inner surface of front and back panels 11–16 so that they come into tight contact with the body when put on, at an appropriate position without movement. The attaching/detaching connector 26 may be formed with one of ordinary button, snap button, hook and magic tape.

The male upper garment constructured as above is characterized as follows when put on.

When the first, second or third embodiment of athletic shirt 10, tank top 10A, or T-shirt 10B is worn, pectoralis major, deltoid, and trapezius reinforcing pads 21, 23, 24, and pad extending portion 22 are appropriately located on the surface of the pectoralis major on the breasts, the deltoid on the shoulders, and the trapezius on the upper back, and are in tight contact therewith by means of a compression preventive material coated along the sewing line on the inner surface of front and back panels 11–16. With those pads 21–24, a weak upper part of body looks three-dimensional and muscular. Their durability which may decrease due to washing can be elongated with attaching/detaching connector 28. The detachable pad is advantageous in buying and wearing it according to the wearer's physical structure or taste.

Meanwhile, the present invention may be applied to other clothes, for instance, to various female uppergarments, not limited to the above embodiments of male upper garments. In this case, women of a weak upper part do not need to wear a brassiere that tightens their body.

Those embodiments of the present invention may be applied also to male or female undergarments, not limited to outer garments. In case of wearing an outer garment such as jacket, sweater or T-shirt with the undergarment of the present invention being put on, the same effects are yielded.

As described above, in the present invention, various reinforcement pads are fixed or detachably attached on the inner surface of the upper garment along the shape of pectoralis major, deltoid or trapezius muscles so that men of weak breasts, especially, the upper part, look muscular with well-developed muscles. Therefore, they can wear tight clothes not reluctantly within a broad range of choice, while appropriately expressing their own individuality along the trend of fashion, as well as eliminating the sense of inferiority against their own physical shape but providing self-confidence.

It will be apparent to the reader that the foregoing description of the invention has been presented for purposes of illustration and description and for providing an understanding of the invention and that many changes and modifications can be made without departing from the scope of the invention. It is therefore intended that the scope of the invention be indicated by the appended claims rather than by the foregoing description; and all changes which come within the meaning and range of equivalency of the claims are therefore intended to be embraced therein.

What is claimed is:

1. A male upper garment comprising:

front and back panels having sides, upper side edges and upper edge portions sewn to form shoulder portions, a neck opening at a top center and two arm openings on the upper side edges; and a pair of pectoralis major reinforcing means each having a recess for receiving a wearer's respective left or right pectoralis major muscles, the reinforcing means each have a thickness and width being tapered from a bottom end of the recess to the shoulders and from a center of either the left and right pectoralis major muscles to their sides, the reinforcing means being attached to portions of an inner surface of the front panel opposing the wearer's pectoralis major muscles, whereby the garment displays an appearance of a man having a well developed pectoralis major muscle.

2. The upper garment as claimed in claim 1, further comprising a pair of deltoid reinforcing pads, each pad having the same shape and thickness as those of a well-developed deltoid muscle and each deltoid reinforcing pad being attached to each respective upper end of the pectoralis major reinforcing pads so that said deltoid reinforcing pads extend from said pectoralis major reinforcing pads.

3. The upper garment as claimed in claim 1, further comprising a pair of trapezius reinforcing pads, each pad of a shape and thickness corresponding to those of a well developed trapezius muscle; each of said pads attached on an inner surface of the back panel and is in a position opposing each of the wearer's respective left and right trapezius muscles, whereby said wearing of said garment gives the appearance of a man with a left and right well developed trapezius muscles.

4. The upper garment as claimed in claim 1, further comprising an inner layer for fixedly encasing the pectoralis major reinforcing means on the inner surface of the front panel.

5. The upper garment as claimed in claim 1, further comprising a plurality of detaching means for detachably attaching the pectoralis major reinforcing means on the inner surface of the front panels.

6. The upper garment as claimed in claim 4, wherein the detaching means is made of an ordinary button, hook and loop fastener or adhesive tape.

7. The upper garment as claimed in claim 1, wherein the pectoralis major reinforcing means comprises:

a pair of pectoralis major pads, each three-dimensionally shaped like a respective pectoralis major muscle and coming into close contact with the outer surface of both of a wearer's breast muscles; and a pair of pads extending portions, each integrally extending from each pad top end of the pectoralis major reinforcing pads to the wearer's shoulders.

8. The upper garment as claimed in claim 1, wherein the garment is a tank top.

9. The upper garment as claimed in claim 1, wherein the garment is a T-shirt.

10. The upper garment as claimed in claim 1, wherein the reinforcing pads and the pair of pad extending portions are made of anyone of a non-woven fabric or an elastic synthetic resin that is a flexible, soft, cushiony shape memory material.

11. The upper garment as claimed in claim 7, further comprising compression preventing means coated along a sewing line placed on the inner surface of the reinforcing pads and pad extending portions to yield a tight contact with the panels without movement.

12. The upper garment as claimed in claim 7, further comprising compression preventing means coated along a sewing line placed on the inner surface of the reinforcing pads and pad extending portions to yield a tight contact with the panels without movement.

13. The upper garment as claimed in claim 1, wherein the garment is an undergarment.

* * * * *